United States Patent [19]

Bassan

[11] 4,276,005

[45] Jun. 30, 1981

[54] OIL FLOW METERING STRUCTURE FOR OIL SEALED MECHANICAL VACUUM VANE PUMP

[75] Inventor: Benjamin Bassan, Framingham, Mass.

[73] Assignee: Varian Associates, Inc., Palo Alto, Calif.

[21] Appl. No.: 33,629

[22] Filed: Apr. 26, 1979

[51] Int. Cl.[3] ..... F04C 25/02; F04C 27/02; F04C 29/02; F16N 25/04

[52] U.S. Cl. ..... 418/13; 418/88; 418/98; 184/31; 415/90; 415/92

[58] Field of Search ..... 418/11-13, 418/97-99, 88; 184/31; 415/90, 92

[56] References Cited

U.S. PATENT DOCUMENTS

| | | | |
|---|---|---|---|
| 2,246,277 | 6/1941 | Davidson | 418/96 |
| 2,668,655 | 2/1954 | Bowering | 418/98 |
| 2,877,946 | 3/1959 | Garrison et al. | 418/13 |
| 2,902,210 | 9/1959 | Power | 418/13 |
| 3,399,826 | 9/1968 | Andriulis | 418/99 |
| 4,025,242 | 5/1977 | Webb | 418/99 |

FOREIGN PATENT DOCUMENTS

| | | | |
|---|---|---|---|
| 449260 | 7/1949 | Italy | 418/98 |

OTHER PUBLICATIONS

Power, B. D. *High Vacuum Pumping Equipment*, 1966, Reinhold Publishing Corp., N. Y. pp. 12-18.

*Primary Examiner*—John J. Vrablik
*Attorney, Agent, or Firm*—Stanley Z. Cole; Leon F. Herbert

[57] ABSTRACT

A mechanical rotary vane vacuum pump has high and low vacuum stages for a pumped gas. Each stage includes a rotor for vanes cyclically driven about a common axis that is eccentric to a cylinder of a stator; the stator of each stage includes an inlet and outlet for the pumped gas. An oil seal between inlets and outlets for each stage is in a narrow gap between the stator and rotor. An interstage structure includes a flow path between the stages for the pumped gases and a shaft drivingly connected the rotors of the stages. An oil flow path comprises a first passage through the interstage structure leading radially to the shaft. The shaft includes diametrically opposed oil metering flats or cavities longitudinally aligned with an outlet of the first passage. A second passage through the interstage structure is longitudinally aligned with the cavities and leads tangentially from the peripheries of the shaft and a bore for the shaft. The second passage is in fluid flow relation with the cylinder of the low vacuum stage so oil metered by the cavities bursts into the second passage and flows to the cylinder of the low vacuum stage to form the oil seal and lubricate surfaces between the rotor and stator.

6 Claims, 12 Drawing Figures

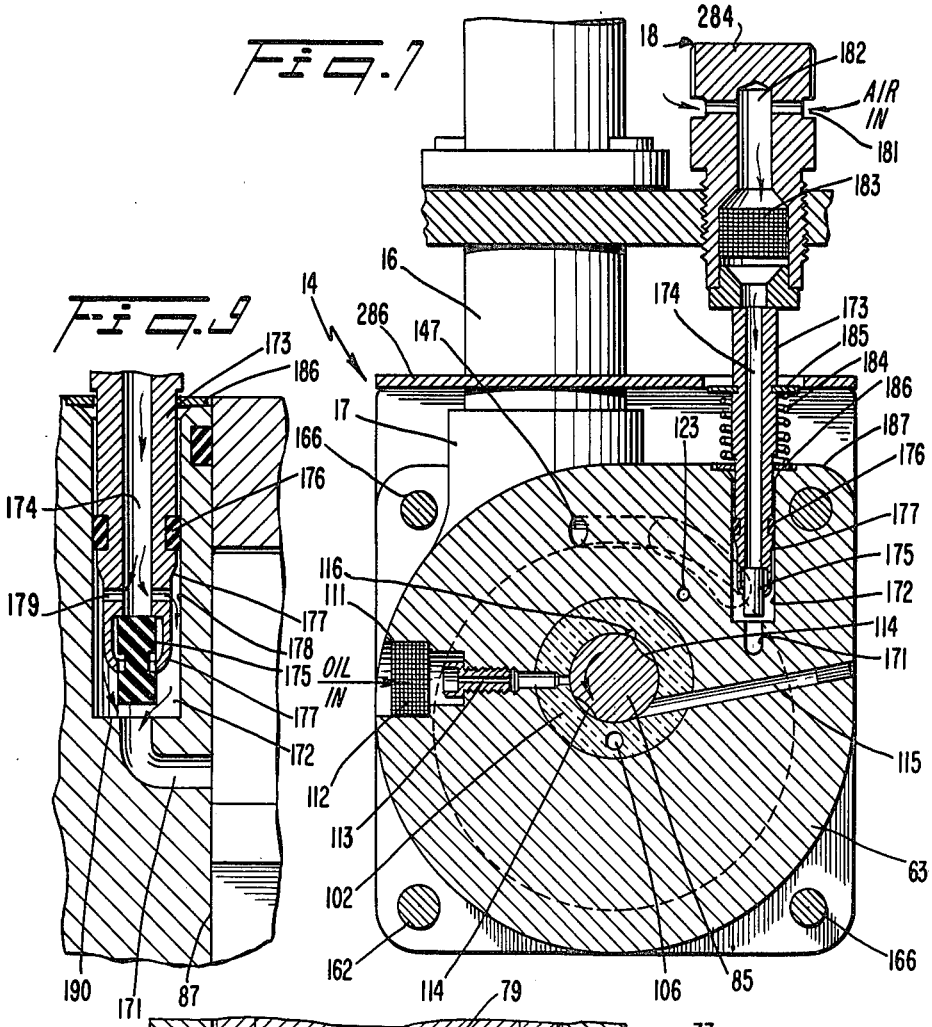
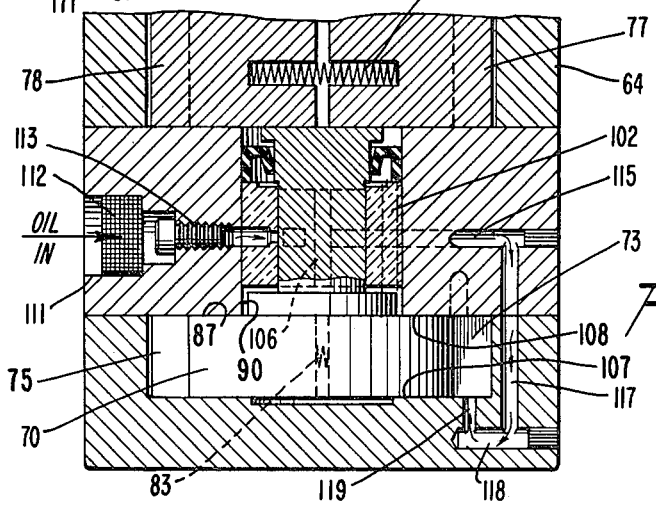
Fig. 8

OIL FLOW METERING STRUCTURE FOR OIL SEALED MECHANICAL VACUUM VANE PUMP

TECHNICAL FIELD

The present invention relates generally to oil sealed, mechanical vane vacuum pumps and more particularly to such a vacuum pump wherein a tangential flow oil passage is provided from an oil metering flat or cavity.

BACKGROUND ART

Oil sealed, mechanical rotary vacuum vane pumps have been extensively utilized in the past, both as primary pumps for vacuum loads of $10^{-4}$–$10^{-1}$ mm. of mercury, or as fore pumps in combination with diffusion pumps for vacuum loads of greater than $10^{-4}$ mm. of mercury. Such pumps usually include several stages, referred to as high and low vacuum stages. Each stage includes a plurality of vanes that cyclically rotate about the axis of a rotor eccentrically mounted in a cylindrical bore of a stator. As the vanes turn, they pump gas between inlet and outlet ports that are physically close to each other in the stator, but which are as far as possible from each other in the pumped gas flow path. To this end, the rotor and stator are designed so there is a very narrow gap between them in a region bridging the inlet and outlet ports. An oil seal is formed in this region by a dam for the pumped gas. The dam is formed by oil supplied to the pump for sealing and lubrication purposes. In a two stage pump, the rotors of the high and low vacuum stages are drivingly connected by a shaft that extends through an interstage structure between the high and low vacuum stages.

As disclosed in the textbook *High Vacuum Pumping Equipment* by B. D. Power, 1966, Reinhold Publishing Corporation, New York, page 18, it is known to intermittently feed oil to a vacuum pump by way of metering flats on a shaft for the rotor of one of the stages. The flats are diametrically opposite from each other and aligned with radially extending passages. One passage leads from a source of oil, on one side of the shaft, while the other passage leads to one of the stages on the other side of the shaft. This prior art device has several advantages because the amount of oil supplied to the stages is a direct function of the sealing requirements of the stage, due to the coupling of a metering mechanism directly to the rotor.

However, the radial disposition of both passages for feeding oil to the shaft and for feeding oil from the shaft to the vacuum stages has a substantial disadvantage. In particular, oil droplets supplied by a metering flat to the conduit leading to the vacuum stage encounter a relatively high flow impedance. The high flow impedance occurs because the droplets have a tendency to impinge on a wall of the conduit leading from the flat. Because the oil droplets impinge on the wall, a dam has a tendency to be formed immediately downstream of the flat, frequently preventing the flow of oil to the vacuum stage until the conduit has been filled.

DISCLOSURE OF THE INVENTION

In accordance with one aspect of the present invention, the above-noted deficiency in the prior art is obviated by arranging a passage from a shaft metering flat to a vacuum stage to be tangential to the shaft periphery and the periphery of the bore through which the shaft extends. Because of centrifugal force, oil drops metered from the flat are projected along the tangentially extending passage. Thereby, oil droplets burst into the tangential passage at a relatively high velocity and readily flow to the vacuum stage to form the oil seal or dam, as well as to lubricate the surfaces between the rotor and the stator. Oil thus flows into the vacuum stage without damming up in the passage leading from the metering flat to the stage.

The invention is preferably utilized in an oil sealed, mechanical rotary vacuum vane pump having high and low vacuum stages for a pumped gas. The shaft containing the metering flats or cavities extends through an interstage structure and connects the rotors of the high and low vacuum stages together. The oil flows to the low vacuum stage and is sucked to the high vacuum stage through a conduit in the interstage structure.

In accordance with another aspect of the invention, oil supplied to the metering flat or cavity flows into a slot in a bearing for the shaft extending through the interstage structure. The oil flowing in the slot lubricates the bearing surface.

A further feature of the invention is that the cavities have concave, curved bases in the shaft, so they can meter relatively large quantities of oil without materially reducing the shaft strength.

Another important advantage of the invention is that flow into the pump stops as the pump stops. This result is achieved by providing a minimum running clearance between the metering shaft and a bearing surrounding the flats or cavities. Practically no oil flows around the shaft at rest and a relatively high vacuum is maintained in the pump while the shaft is at rest.

It is, accordingly, an object of the present invention to provide a new and improved oil flow path for an oil sealed, mechanical rotary vane vacuum pump.

Another object of the invention is to provide a new and improved oil flow path including a shaft metering flat or cavity for an oil sealed, mechanical rotary vane vacuum pump.

A further object of the invention is to provide a new and improved oil flow path for an oil sealed mechanical rotary vane vacuum pump wherein oil droplets are ejected into a passage at relatively high speeds from a metering flat or cavity of a shaft that drives a rotor of the pump.

A further object of the invention is to provide an oil flow path which is arranged to obviate the formation of oil pools in an oil sealed, mechanical rotary vane vacuum pump, to enhance circulation and cooling of the oil.

Still a further object of the invention is to provide a new and improved oil flow path for an oil sealed mechanical rotary vane vacuum pump wherein some of the flow paths that supply oil to lubricate the parts are also used to supply oil for vacuum seals in the pump.

The above and still further objects, features and advantages of the present invention will become apparent upon consideration of the following detailed description of one specific embodiment thereof, especially when taken in conjunction with the accompanying drawings.

BRIEF DESCRIPTION OF THE DRAWINGS

FIG. 1 is a side view, partly in section, of a mechanical, oil sealed, rotary vacuum vane pump assembly in accordance with the present invention;

FIG. 2 is a top view of the pump portion of the assembly of FIG. 1;

FIG. 3 is a front view of the pump portion of the assembly of FIG. 1;

FIG. 4 is a top view of a pump housing in the assembly of FIG. 1, in combination with a fan and a drive shaft for parts within the pump housing;

FIG. 7 is a cross-sectional view, taken along the lines 7—7, FIG. 5 wherein there is illustrated a portion of the interstage structure between high and low vacuum stages of the pump;

FIG. 8 is a sectional view taken through the lines 8—8 of FIG. 6, wherein there are illustrated the low vacuum stage, interstage structure, and a portion of the high vacuum stage of the pump;

FIG. 9 is an enlarged view of a portion of a gas ballast structure illustrated generally in FIG. 7;

BEST MODE FOR CARRYING OUT THE INVENTION

Figure 5:
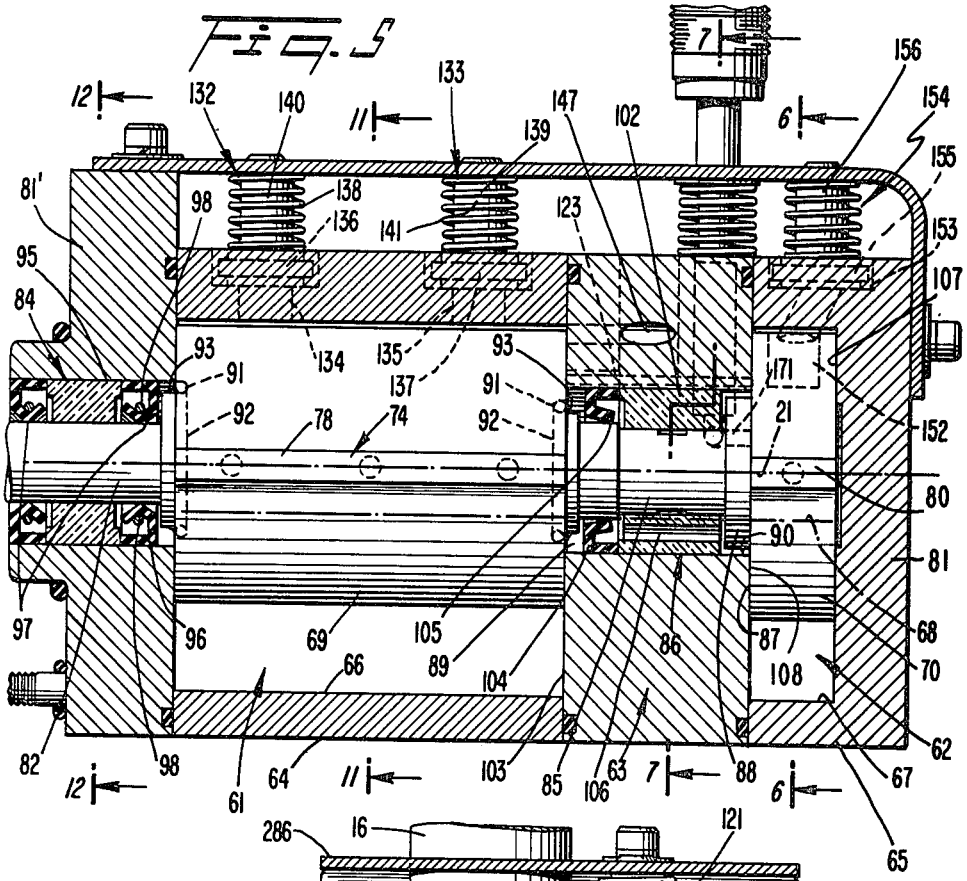
FIG. 5 is a side sectional view of apparatus included within the pump housing of FIG. 4.
Figure 6:
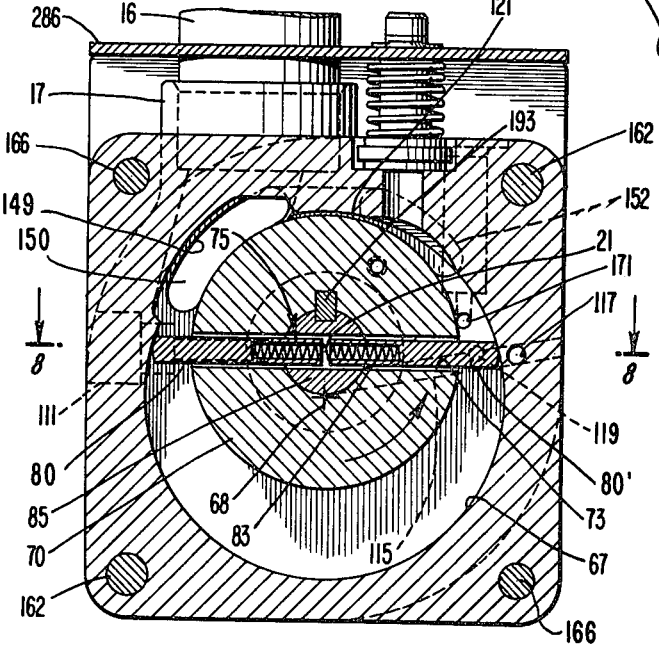
FIG. 6 is a sectional view, taken through the lines 6—6 of FIG. 5, wherein there is illustrated a portion of a low vacuum stage in accordance with the invention.
Figure 10:
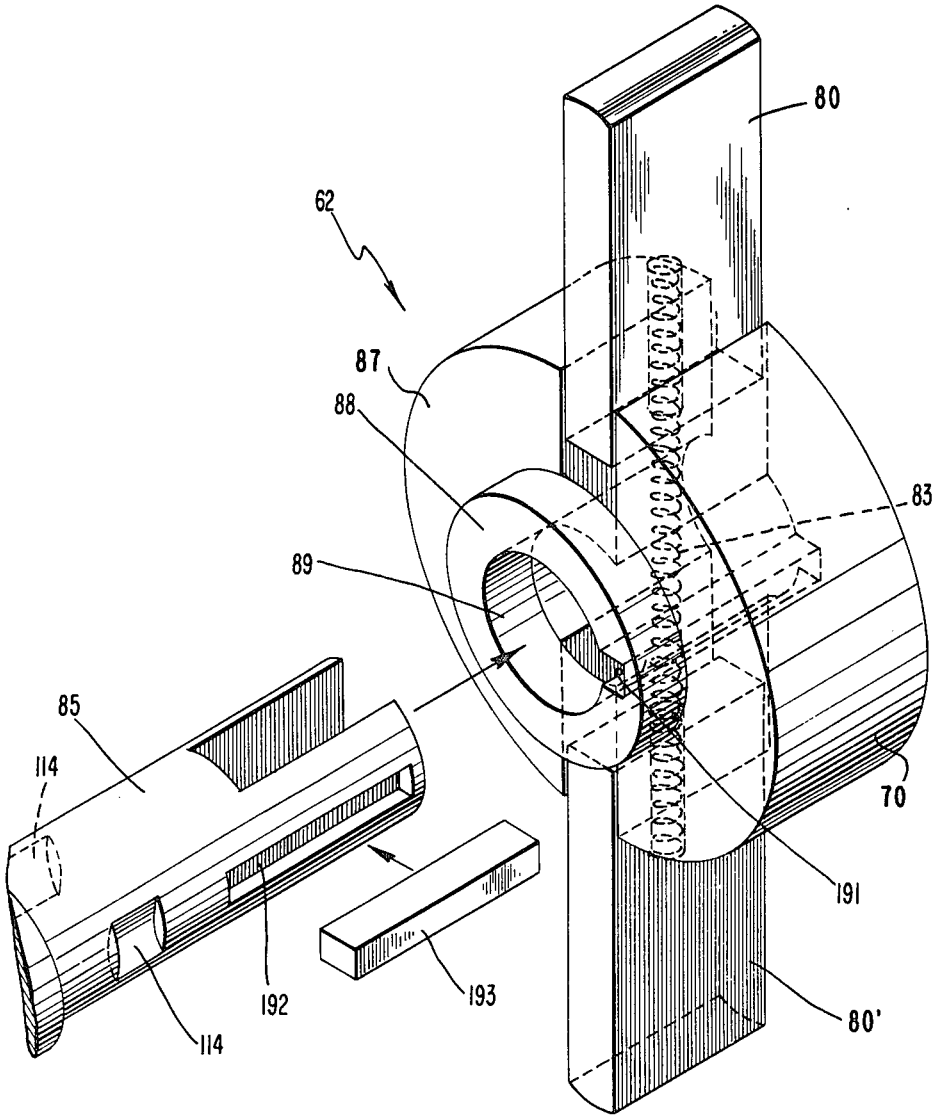
FIG. 10 is an exploded perspective view of a rotor of the low vacuum stage, in combination with a drive shaft for the rotor which is integral with a rotor for the high vacuum stage.

Reference is now made to FIGS. 1-4 of the drawings wherein a vacuum pump assembly 10 includes a pump casing 11, a fan assembly 12, and an electric motor 13. Within casing 11 is pump housing 14 which is immersed in oil pool 15. Oil from pool 15 is pumped to the interior of housing 14 to establish vacuum seals in the housing, and to lubricate parts within the housing. A region to be evacuated to a vacuum condition is connected to inlet 17 of housing 14 by conduit 16 that extends through a suitable aperture in casing 11. Housing 14 includes two pumping stages of the vane type having oil seals or dams that prevent the flow of gas between certain surfaces and ports within housing 14 between an inlet and outlet through conduit 16. The dams or seals are formed by oil from pool 15 being pumped interiorly of housing 14. To prevent oil condensation and plugging of a low vacuum stage within housing 14, air is supplied to the low vacuum stage by gas ballast device 18 that supplies air from outside of casing 11 to the interior of housing 14 by way of conduit 19. Gas pumped by assembly 10 escapes from an outlet of the low vacuum stage, bubbles through oil pool 15 and vents to the atmosphere through an aperture in the side of cap 20, on the roof of casing 11.

The vanes within housing 14 rotate about a common longitudinal axis 21 that is aligned with output shaft 22 of motor 13. The vanes are mounted in rotors which are driven by shaft 22 through shaft coupling and bearing 23 that is located in fan assembly 12. Fixedly mounted on shaft 22 is fan 24 which is driven by shaft 22 in the same direction as the vanes within housing 14. Fan 24 is a conventional laminar flow air pump that draws air in an axial direction from the vicinity of motor 13 and pumps it axially toward casing 11.

On the vertical surface or wall of casing 11 remote from motor 13 are located plug 25 and sight glass 26. Plug 25 is located at the bottom of casing 11, so that the bottom edge of the plug is coincident with the interior floor of the casing so all of the oil can easily be drained from pool 15. Sight glass 26 is mounted at the top of casing 11 so that a viewer is able to determine when pool 15 covers all of the structure associated with pump housing 14. Pump housing 14 is fixedly mounted to casing wall 27 by suitable nut and bolt assemblies 28.

Fan 24 provides a flow of air to cool the oil in pool 15. The oil in pool 15 has a tendency to be heated because it is circulated within housing 14. In addition, oil in pool 15 has a tendency to be heated in response to the heat of friction transmitted to the exterior of housing 14. To provide a relatively low cost structure for cooling the oil in pool 15, casing 11 is provided with vertically extending fins 31 on its lower surface 30, horizontally extending fins 32 and 33 on its opposed vertically extending sides 34 and 35, and vertically extending fins 36 on its face 37 remote from motor 13; fins 36 and 31 are vertically aligned.

Laminar air pumped by fan 24 flows axially out of fan assembly 12 to the bases of fins 31-33. Assembly 12 includes apertured disc 42, mounted at right angles to shaft 22. Disc 42 includes a relatively large central aperture 40, having a circular diameter approximately equal to, but slightly less than, the diameter of the blades of fan 24. Disc 42 is disposed parallel to adjacent end face 43 of motor 13 and is arranged relative to the motor so that open segment 50 is provided below the motor. Air is pumped by fan 24 to flow through segment 50 and disc aperture 40 into shroud 41 and thence out of the shroud in a direction generally parallel to axis 21 against fins 31-33. The air flows from the bottom of shroud 41 against fins 31 through horizontally extending slot 46, close to the bottom of end plate 27. Vertically extending slots 47 and 48 on opposite sides of plate 27 direct air flowing out of shroud 41 against fins 32 and 33, respectively. The elongated nature of slots 46-48 and the positioning thereof relative to fins 31-33, as well as the nature of fan 24, establishes a laminar air flow between adjacent fins to enhance cooling. It has been found that the laminar air flow, rather than a turbulent flow, enables relatively low speed axial or laminar flow fan 24 to be employed. In addition, the relative position of slots 46-48 and the bases of fins 31-33 on bottom and side surfaces 30 of casing 11 enables the pumped air to intercept the base of the fins at a relatively shallow angle to prevent substantial reflection of the pumped air that impinges on the bases of the fins. In one particular embodiment, the relatively shallow angle between slot 46 and the base of fins 31, on bottom surface 30, has a maximum angle of approximately 25°.

Pump casing 11 and motor 13 are cantilevered to the centrally located fan assembly 12, which in turn includes longitudinally extending feet 51 that extend in opposite directions from the fan assembly. The entire pump assembly 10 is easily carried by providing fan assembly 12 with a handle 52.

Reference is now made to FIGS. 4-12 wherein there are illustrated details of the structure included within pump housing 14. The pump within housing 14 includes a high vacuum stage 61, a low vacuum stage 62, and an interstage structure 63 disposed between the high and low vacuum stages. The high vacuum stage, the interstage structure, and low vacuum stage are longitudinally disposed in the named sequence along axis 21 relative to fan assembly 12.

Stages 61 and 62 respectively include stators 64 and 65, having longitudinally aligned cylindrical bores 66 and 67 and a common axis 68 which is vertically displaced relative to axis 21 for motor shaft 22 so the bores are eccentrically positioned relative to the rotors. Eccentrically mounted in cylindrical bores 66 and 67 are cylindrical rotors 69 and 70, mounted to rotate about axis 21 and drivingly connected to motor shaft 22. Captured within angularly aligned diametric slots 72 and 73 of rotors 69 and 70 are plastic spring biased vane assemblies 74 and 75. Slots 72 and 73 extend completely through rotors 69 and 70, along a diameter of each rotor to capture angularly aligned vane assemblies 74 and 75 against the walls of bores 66 and 67. Vane assembly 74 includes oppositely disposed plastic vanes 77 and 78 having tips that are biased by spring 79 against the entire length of the wall along cylindrical bore 66. Because of the length of rotor 69 and vane assembly 74, multiple sets of longitudinally positioned springs 79 are provided to assure contact of the vanes 77 and 78 along the entire bore length. Vane assembly 75 includes oppositely disposed plastic vanes 80 and 80', having tips that are biased by two springs 83 against the wall of bore 67. Because vane assemblies 74 and 75 turn at the same speed, but the vanes of assembly 74 are considerably longer than the vanes of assembly 75, the high vacuum stage has a much higher speed than the low vacuum stage. Although the low vacuum stage has a much lower pumping speed than the high vacuum stage, is much higher operating pressure allows it to pump all of the gas delivered to it by the high vacuum stage, particularly once the region to be evacuated has been drawn down to the required vacuum.

Rotors 69 and 70 are mounted on a shaft assembly having its axis coincident with axis 21, and which is cantilevered to bearing assemblies 86 and 84 in interstage structure 63 and end plate 81' of housing 14. The shaft assembly includes a first shaft 82 that is connected to motor shaft 22 by bearing and coupling member 23 and which extends through bearing assembly 84 in end plate 81'. The shaft assembly also includes stub shaft 85 which is mounted on bearing assembly 86 in interstage structure 63. The end of rotor 70 remote from end plate 81 is cantilevered, whereby the necessity to have a further bearing structure is obviated.

Rotor 70 is constructed, either by machining or casting, as a single metal piece that does not require any welds, even though it includes diametric slot 75. To this end, ring 88 extends from and is a part of face 87 of rotor 70. Face 87 is parallel to and abuts against corresponding face 108 of interstage structure 63, having bore 90 that receives the ring 88. Ring 88 includes a central bore 89 having a keyway 191 that is mated with keyway 192 of stub shaft 85. Key 193, positioned in keyways 191 and 192, holds ring 88 and rotor 70 fixed relative to shaft 85. By forming rotor 70 as a single piece, the necessity to weld an exterior ring to face 87 is obviated and the length of vane 75 can be maximized in a minimum amount of space. In contrast, rotor 69 is attached to shaft 82 and stub shaft 85 by discs 91 which fit into cavities 92 on opposite faces of rotor 69 and are secured to the rotor by welds 93.

Bearing assembly 84 includes an annular, bronze bushing 95 against which shaft 82 bears. At opposite ends of bushing 95 are mechanical vacuum seals 96, preferably formed of rubber or the like, and having sealing surfaces 97. Oil is supplied to seals 96 from pool 15 by way of conduits 99 and 101 that extend through plate 81' and feed diametrically opposed narrow flats 194 on shaft 82 that are longitudinally aligned with the orifices of passages 99 and 101 in the bearing sleeve 95. These flats carry oil around the inner bore of bushing 95 and shaft 82 and supply oil to grooves 100 which transport the oil to seals 96 and simultaneously lubricate the bearing surfaces of bushing 95. This oil feeding arrangement provides significant restrictions to oil flow around the shaft 82 when the pump is stopped. The restrictions help prevent the unwanted introduction of oil into high vacuum stage 61 across seal 96. Introduction of oil into stage 61 would eventually fill pump housing 14 and allow oil to be sucked back into the evacuated chamber.

Bearing assembly 86 for stub shaft 85 includes a bronze bushing 102 having a bore against which the periphery of shaft 85 bears. Between the end of bushing 102 remote from rotor 70 and the face 103 of interstage structure 63 adjacent to and abutting against vanes 77 and 78 is an annular mechanical seal 104. Seal 104 has a sealing surface 105 against a portion of shaft 85 proximate face 103. Oil is supplied to seal 104 through passage 106 which extends longitudinally of bushing 102 from low vacuum stage 62 at the intersection between rotor 70 and face 108 of interstage structure 63.

The path for oil supplied to low vacuum stage 62 and thence to seal 104 and high vacuum stage 61 begins at cavity 111 in interstage structure 63. Because there is a relatively long flow path for the oil, from the inlet in interstage structure 63, through low vacuum stage 62, thence again through the interstage structure to high vacuum stage 61, the oil is outgassed prior to being introduced into the high vacuum stage. Outgassing of the oil prevents helium or other light gases trapped in the oil from being transferred from low vacuum stage 62 to high vacuum stage 61, and assists in removing helium and other light weight gases from the pump and region being evacuated. The oil flow path is relatively long because the oil is introduced into the vicinity of the highest pressure region of the pump in low vacuum stage 62 through an aperture in face 107, remote from interstage structure 63 and the high vacuum stage 61. Thence the oil is sucked through various passages to the highest vacuum portions of the pump at the face of rotor 69 remote from interstage structure 63. The particular oil flow path prevents formation of oil pools in the pump, thus enhancing circulation and cooling of the oil. In addition, many of the same oil paths that enable the various parts to be lubricated are used for supplying oil to seals in the pump.

The oil flow path to interstage structure 63 from pool 15 begins at cavity 111, having filter 112 therein, and continues through passage 113, which extends radially of shaft 85 and has an orifice in the shaft bore of bearing sleeve 102. On the periphery of shaft 85 are diametrically opposed relatively narrow flats or cavities 114 that are longitudinally aligned with the orifice of passage 113 in bearing sleeve 102. Cavities 114 are centrally located in stub shaft 85 and extend only a small distance from the center to capture a relatively large quantity of oil between them and the shaft bore of bearing sleeve 102. Cavities 114 have concave, curved bases in shaft 85, enabling them to have relatively large volumes without materially reducing the strength of the shaft. Oil metered through cavities 114 in response to rotation of shaft 85 bursts into and through passage 115, positioned so its orifice is longitudinally aligned with the cavities. Passage 115 extends in a straight line tangential to the peripheries of stub shaft 85 and the shaft bore in bearing sleeve 102. Because of centrifugal forces and the tangential relationship of passage 115 to the peripheries of stub shaft 85 and the shaft bore, oil droplets are tangentially ejected from cavities 114 and are slung at high speed through passage 115 to assure thorough distribution of the oil droplets and prevent damming. Oil in cavities 114 also lubricates the surface between shaft 85 and bearing sleeve 102, a result achieved by providing the interior surface of the bearing sleeve with a relatively small longitudinal slot 116. Thereby, oil in cavities 114 oozes out of the cavities into slot 116 as the cavities pass the slot.

The tangentially ejected oil droplets traversing passage 115 are deflected at right angles into passage 117 that extends longitudinally of axis 21 in interstage structure 63 and stator 65. After traversing passage 117, the oil flows through passages 118 and 119, respectively at right angles and parallel to axis 21. The oil in passage 119 enters cylindrical bore 67 through wall 107 in proximity to pumped gas outlet cavity 152, approximately the highest pressure region in the pump. The oil entering cylindrical bore 67 through passage 119 is picked up by rotor 70 and the tips of vanes 80 and 80' so it is wiped by the vanes on the periphery of the wall of the bore. The oil wiped by the tips of blades 80 and 80' on the periphery of bore 67 is accumulated as an oil seal or dam 121 in a narrow gap or region where rotor 70 is in very close proximity to stator 65, along a horizontal surface intersecting a vertical line extending upward from axes 21 and 68 for rotor 70 and cylindrical bore 67.

Oil wiped by vanes 80 and 80' and excess oil accumulated in dam 121 drips along the periphery of rotor 70 to the face of the rotor proximate end face 108 of interstage structure 63. The oil flowing along the intersection between rotor 70 and face 108 leaks past ring 88 of rotor 70 into passage 106 and thence flows into seal 104. In addition, oil between the interface of rotor 70 and face 108 is sucked longitudinally through passage 123 to high vacuum stage 61, at the face of rotor 69 which abuts against interstage face 103. From the intersection between rotor 69 and face 103, the oil flows by centrifugal force outwardly along the face of rotor 69 to the periphery of cylindrical bore 66. Sufficient oil is accumulated to form oil seal or dam 124 at the point of closest proximity between rotor 69 and stator 64, along a horizontal surface intersecting a line extending vertically upward from the intersection between axes 21 and 68. In addition, oil is wiped by the tips of vanes 77 and 78 about the periphery of cylindrical bore 66, and some oil drips between the interface of plate 81' and rotor 69. The amount of oil introduced into high vacuum stage 61 is considerably less than the amount of oil introduced into the low vacuum stage 62, because of the great distance the oil must travel from its point of entry to the high vacuum stage. This is desirable because the oil has been substantially outgassed by the time it reaches the high vacuum stage. Because the moving parts of the high vacuum stage have less mechanical loading thereon than the moving parts of the low vacuum stage, less lubrication is required for the high vacuum stage.

Consideration is now given to the flow path for gas sucked by the pump in housing 14 from a load region to be evacuated. The gas flows from the region through conduit 16 in high vacuum stage 61 via inlet 17. From inlet 17, the gas flows through conduit 131 into cylinder 66 on the left side of oil seal 124, as viewed in FIG. 11. The pumped gas initially enters cylinder 66 in a central portion of the cylinder, but flows longitudinally of the cylinder toward interstage structure 63 and wall 81'. The gas drawn through inlet 17 is pumped by vanes 77 and 78 until it reaches the opposite side of oil seal 124, on the right side of the seal as viewed in FIG. 11.

When the load region is initially evacuated and there is a relatively high pressure gas flowing through inlet 17, the gas pumped by vanes 77 and 78 to the vicinity of the right side of seal 124 flows out of cylinder 66 by way of spring biased poppet valves 132 and 133, having inlet conduits 134 and 135 into cylinder 66. Inlets 134 and 135 are longitudinally spaced on opposite sides of inlet 17 close to and on the right side of dam 124, i.e., downstream of the dam in the flow path of the pumped gases. Poppet valves 132 and 133 include wafers 136 and 137 which are normally urged to a closed position by springs 138 and 139. Tubular conduits 140 and 141 of poppet valves 132 and 133 extend through housing 14 so the relatively high pressure gas pumped initially from the load overcomes the bias of springs 138 and 139 to open wafers 136 and 137 and escapes directly into oil pool 15.

In response to the pressure of the gas being pumped from the evacuated region being sufficiently reduced, poppet valves 132 and 133 close and a flow path is established from high vacuum stage 61 to low vacuum stage 62 via conduit 143, FIG. 4, in interstage structure 63. Conduit 143 has a single outlet 144 through wall 103 of interstage structure 63. Conduit 143 has a relatively low flow impedance and provides a streamlined high efficiency air passage between cylinders 66 and 67. The low impedance is provided, inter alia, by the opening of conduit 143 through face 103 into cylinder 66, the in-line position of the conduit with the outlet of stage 61 and the inlet of stage 62, and because the conduit extends along a straight line between the outlet of stage 61 and inlet of stage 62. Because of the streamlined flow path through conduit 143, there is a relatively smooth flow of pumped gas through the conduit, to enable the conduit to have a relatively small cross section and volume between stages 61 and 62. In addition, the use of a single outlet from stage 61 to interstage structure 63 reduces wear on face 103 and the peripheral wall of cylinder 66 in the vicinity of the outlet from the cylinder into conduit 143.

Figure 11:
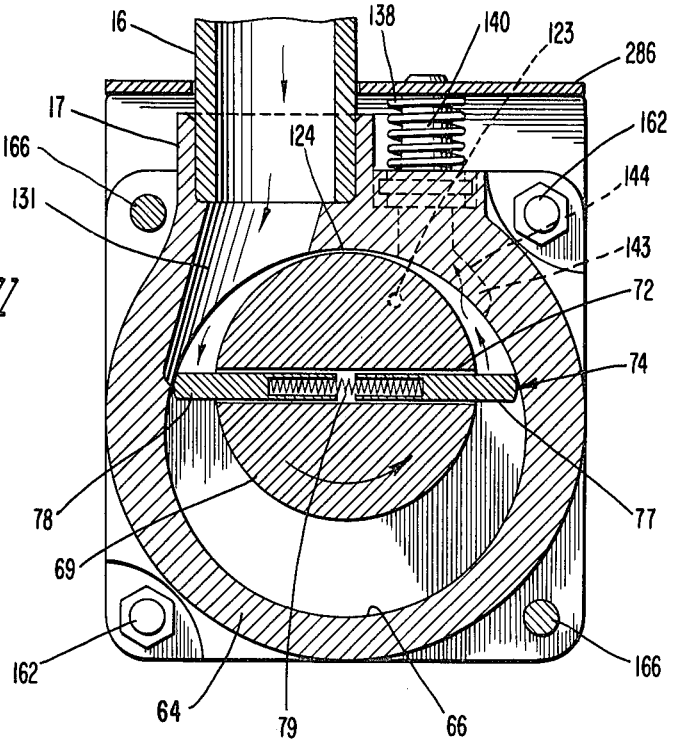
FIG. 11 is a sectional view, taken through the lines 11—11 of FIG. 5, of the high vacuum stage.
Figure 12:
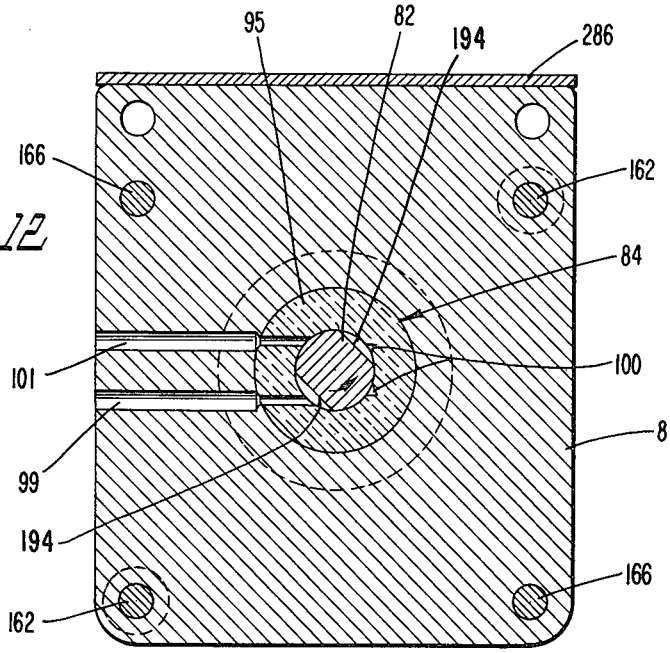
FIG. 12 is a sectional view, taken through the lines 12—12 of FIG. 5, of a bearing structure for the shaft extending between the high vacuum stage and the fan.

To these ends, conduit 143 has a relatively wide, arcuate mouth 144, FIGS. 4 and 11, at the intersection between high vacuum stage 61 and interstage structure 63. Mouth 144 extends approximately 30 degrees about the periphery of cylindrical bore 66 to form the termination of arcuate cavity 145 in high vacuum stator 64. Cavity 145 extends around the periphery of cylindrical bore 66 through the same angle as mouth 144 and has a length in the direction of axis 21 equal approximately to one-third of the length of cylinder 66. From mouth 144, conduit 143 includes an arcuate cavity 146 leading into straight cylindrical segment 147 that extends diagonally across axis 21, into cavity 148. Cavity 148 has an arcuate mouth 149 into cylindrical bore 67 of low vacuum stage 62. Mouth 149 extends arcuately, in a counterclockwise direction as viewed in FIG. 6, about the periphery of rotor 70 for approximately 60 degrees, from a region displaced approximately 10 degrees from the top of cylinder 67 to a region displaced approximately 70 degrees from the top of the cylinder, and is angularly aligned relative to axis 21 with the mouth of inlet 17 into high vacuum stage 61. In contrast, mouth 144 has an angular extent of approximately 30 degrees, from a point displaced approximately 10 degrees from the top of cylindrical bore 66 to an angle approximately 40 degrees displaced from the top of the bore.

The gas flowing through inlet mouth 149 flows into cavity 150 in stator 65 of low vacuum stage 62. Cavity 150 extends partially along axis 21 into low pressure stage 62 so gas pumped through conduit 143 enters cylindrical bore 67 from the cavity for approximately one-third of the length of the bore.

Gas flowing into bore 67 through mouth 149 and cavity 150 is pumped by vanes 80 and 80' to outlet cavity 152 of cylindrical bore 67. Outlet cavity 152 is located on the opposite side of oil seal or dam 121 from inlet cavity 150. Outlet cavity 152 has an angular extent about rotor 70 that is approximately the same as the angular extent of cavity 145 in stator 64 of the high vacuum stage; cavities 145 and 152 are angularly aligned relative to axis 21. Outlet 152 is centrally located within stator 65, so that no face thereof is coincident with end wall 107 of the stator nor end wall 108 of the interstage structure 63. Gas pumped to outlet cavity 152 flows through bore 153 in stator 65 to spring biased poppet valve 154. Poppet valve 154, identical in construction to poppet valves 132 and 133, includes a spring biased wafer 155 which permits escape of pumped gas through conduit 156 into oil pool 15 on a cyclic basis in response to the pressure in cavity 152 exceeding atmospheric pressure, as occurs when vanes 80 and 80' are approaching and are in close proximity to the cavity. The gas flowing into pool 15 through any of poppet valves 132, 133 or 154 bubbles through the oil pool and escapes from casing 11 by way of vent pipe 20.

Tie rod assemblies connect the various parts of housing 14 to each other and secure the housing to wall 27 of fan assembly 12. The use of tie rods, as well as precision manufacturing and proper tolerance control, enables the pump to be assembled without hand fitting of the various parts. In particular, tie rod assemblies 28 include bolts or rods that extend through aligned bores in plates 27 and 81', as well as buttress 161 of high vacuum stator 64. Tie rod assemblies 162 include bolts that extend through aligned bores in buttresses 163, 164 and 165 of high vacuum stator 64, interstage structure 63, and low vacuum stator 65. End plate 81' is threaded to receive threaded bolt 166 that extends through a bore in buttress 165; the bore in buttress 165 is aligned with the threaded bore of end plate 81'. Bolts 166 are secured in place by nuts 167, on the face of stator 65 remote from end plate 81'.

Gas pumped into outlet cavity 152 has a tendency to be at higher than atmospheric pressure when vanes 80 and 80' are approaching and in the vicinity of the outlet cavity. In consequence, there is a tendency for oil vapor in the variable volume chamber between the leading edges of vanes 80 or 80' and outlet cavity 152 to condense in the vicinity of outlet cavity 152, which prevents proper lubrication and sealing. In addition, the introduction of condensed oil in low vacuum stage 62 has an adverse effect on the pump operation because the condensate is outgassed from the oil, requiring additional pumping effort.

Oil condensating is prevented in the present pump by utilizing an improved gas ballast device 18, requiring no moving mechanical parts, such as springs. Air flowing through ballast device 18 flows into cylindrical bore 67 by way of horizontally disposed passage 171, having an orifice into a vertical face of the cylinder upstream of outlet cavity 152 approximately one quarter of a vane cycle prior to the outlet so there is a maximum volume between the orifice and outlet cavity without coupling the orifice directly to inlet cavity 150. Thereby, vane 80 and 80' pump the gas past the orifice of passage 171 prior to pumping it into outlet cavity 152. As illustrated in FIGS. 5 and 9, longitudinal passage 171 extends from the face of cylindrical bore 67 on face 108 of interstage structure 63 horizontally through the interstage structure and thence upwardly through the interstage structure into elongated cavity 172 in the interstage structure. Extending into cavity 172 is sleeve 173, a structure having a vertically extending, longitudinal cylindrical passageway 174, terminated at its lower end by rubber plug or stopper 175. Sleeve 173 fits snugly into elongated cavity 172 by virtue of rubber gasket 176 that establishes a seal from cavity 172 to outside of the pump housing 14. Sleeve 173 has a tapered section 177, immediately below gasket 176 and above a relatively long reduced diameter, annular portion 178, coaxial with passage 174. Immediately below taper 177, sleeve 173 includes relatively small diameter, radially extending, diametrically opposed fluid passages 179 that extend between passages 174 and 178. There is thus formed a tortuous, constricted path between passages 174 and 171 through radial passages 179 and annular passage 178. Air flows through this tortuous, constricted path from inlet 181 and passage 182, via air filter 183 of cap 284 which is screwed in a threaded bore of container 11 and functions as a body to hold the air filter.

The tortuous, constricted path through passages 178 and 179 can be blocked and unblocked by driving stopper 175 against and away from seat 190 formed in the bottom of cavity 172. To this end, coil spring 184 is captured between washers 185 and 186 that encircle sleeve 173. Washer 186 sits in a dish on upper face 187 of abuttment 164 of interstage structure 63, while washer 185 is secured to sleeve 173 at a location normally approximately aligned with plate 286 at the top of container 14. The upper and lower normally abutting edges of sleeve 173 and cap 284 are not fixedly connected, being only in frictional contact with each other so that cap 284 can be removed from casing 11, to replace or clean filter 183, without having to remove sleeve 173. When cap 284 is screwed down, sleeve 173 is translated downwardly so stopper 175 engages seat 190 and spring 184 is compressed. When cap 284 is unscrewed partially or fully, sleeve 173 is urged upwardly by spring 184 so stopper 175 comes off of seal 190 and the sleeve remains in cavity 172, without popping out because of the long length of the cavity in interstage structure 63.

The tortuous, constricted fluid path through radial passages 179 and annular passage 178 is such that the area of the tortuous constricted path is much less than that of passage 174 in sleeve 173 and in cavity 172, and of passage 171. In one preferred embodiment, passageways 171, 174 and 179 respectively have diameters of approximately ⅛", 3/32", and 1/32" while the spacing between the inner and outer diameters of annular region 178 is approximately 1/64". Cavity 172 has a diameter of approximately 5/16" at its intersection with passage 171, whle stopper 175 has a diameter of approximately 3/16". Passage 179 is approximately 5/16" long, while annular region 178 between passage 179 and the bottom of sleeve 173 has a length of approximately 9/16". It has been found that these dimensions enable a tortuous, constricted path to be provided for air flowing into cylinder 67, and yet prevent premature ejection of gas ballast air and oil out of the cylinder in response to the relatively high pressure in the pump in the vicinity of outlet cavity 152. It is believed that oil in cylindrical bore 67 has a tendency to fill passage 171 and prevent the flow of gas through the passage except for a relatively small time during each rotation cycle of rotor 70 immediately after vanes 80 and 80'' pass the opening of passage 171 into bore 67. At this time, vanes 80 and 80'' suck sufficient oil out of passage 171 and the gas ballast structure to enable atmospheric air to flow through the constricted, tortuous path to prevent oil condensation.

While there has been described and illustrated one specific embodiment of the invention, it will be clear that variations in the details of the embodiment specifically illustrated and described may be made without departing from the true spirit and scope of the invention as defined in the appended claims.

I claim:

1. An oil flow path for an oil sealed, mechanical rotary vane vacuum pump having a rotor and vane cyclically driven about an axis that is eccentric to a cylinder of a stator, the stator including an inlet and outlet for the pumped gas, an oil seal between the inlet and outlet in a narrow gap between the rotor and stator, a shaft for driving said rotor, the oil path comprising a first passage leading radially to the shaft from a source of oil, said first passage having an orifice into a bore through which the shaft extends, the shaft including a recess, longitudinally aligned with the first orifice and extending only part way around the shaft so that oil is metered by the recess as the shaft is rotated, a second passage longitudinally aligned with the recess and leading tangentially from the peripheries of the shaft and the bore, means for connecting the second passage in fluid flow relation with the cylinder so oil metered to the recess bursts into the second passage and flows to the cylinder to form the oil seal and lubricate surfaces between the rotor and stator.

2. The oil flow path of claim 1 wherein the second passage lies in a plane substantially perpendicular to the axis of rotation of the shaft.

3. The oil flow path of claim 1 or 2 wherein the shaft includes a pair of diametrically opposed recesses, each of said recesses having a concave, curved base to enable it to meter a relatively large quantity of oil without materially reducing the shaft strength.

4. An oil flow path for an oil sealed, mechanical rotary vane vacuum pump having high vacuum and low vacuum stages for a pumped gas, each of said stages including a rotor for vanes cyclically driven about a common axis that is eccentric to a cylinder of a stator, the stator of each stage including an inlet and outlet for the pumped gas, an oil seal between the inlet and outlet of the low vacuum stage in a narrow gap between the stator and rotor, an interstage structure between the high and low vacuum stages, said interstage structure including a flow path between the stages for the pumped gases and a shaft drivingly connecting the rotors of the high and low vacuum stages, the oil flow path comprising a first passage through the interstage structure leading radially to the shaft from a source of oil, said first passage having a first orifice into a bore in the interstage structure through which the shaft extends, the shaft including a recess longitudinally aligned with the first orifice and extending only part way around the shaft so that oil is metered by the recess as the shaft is rotated, a second passage through the interstage structure longitudinally aligned with the recess, and leading tangentially from the peripheries of the bore and shaft, means for connecting the second passage in fluid flow relation to the cylinder of the low vacuum stage so oil metered by the recess bursts into the second passage and flows to the cylinder of the low vacuum stage to form the oil seal and lubricate surfaces between the rotor and stator.

5. The oil flow path of claim 1 wherein the second passage lies in a plane substantially perpendicular to the axis of rotation of the shaft.

6. The oil path of claim 4 or 5 wherein the shaft includes a pair of diametrically opposed recesses, each of said recesses having a concave, curved base to enable it to meter a relatively large quantity of oil without materially reducing the shaft strength.

* * * * *